US008376576B2

(12) United States Patent
Sloan et al.

(10) Patent No.: US 8,376,576 B2
(45) Date of Patent: Feb. 19, 2013

(54) PERIMETER LIGHTING

(75) Inventors: Thomas C. Sloan, Santa Barbara, CA (US); Bruce Quaal, Ventura, CA (US)

(73) Assignee: The Sloan Company, Inc., Ventura, CA (US)

( * ) Notice: Subject to any disclaimer, the term of this patent is extended or adjusted under 35 U.S.C. 154(b) by 156 days.

(21) Appl. No.: 11/788,730

(22) Filed: Apr. 19, 2007

(65) Prior Publication Data

US 2007/0274067 A1 Nov. 29, 2007

Related U.S. Application Data

(60) Continuation-in-part of application No. 11/100,087, filed on Apr. 5, 2005, now Pat. No. 7,448,768, which is a division of application No. 10/770,956, filed on Feb. 2, 2004, now Pat. No. 6,969,179, which is a division of application No. 10/202,276, filed on Jul. 24, 2002, now Pat. No. 6,776,504.

(60) Provisional application No. 60/307,820, filed on Jul. 25, 2001, provisional application No. 60/906,910, filed on Mar. 13, 2007.

(51) Int. Cl.
*F21S 4/00* (2006.01)

(52) U.S. Cl. ..... 362/249.02; 362/221; 362/227; 362/234; 362/248; 362/311.02; 362/555; 362/576; 362/800

(58) Field of Classification Search ..... 362/277, 362/800, 234, 555, 576, 221, 249.02, 249.03, 362/248, 311.02
See application file for complete search history.

(56) References Cited

U.S. PATENT DOCUMENTS

| | | | | |
|---|---|---|---|---|
| 4,439,818 | A | 3/1984 | Scheib | 362/250 |
| 4,521,839 | A | 6/1985 | Cook et al. | 362/238 |
| 4,712,165 | A | 12/1987 | Cetrone | 362/147 |
| 4,812,956 | A | 3/1989 | Chen | 362/249 |
| 5,099,401 | A | 3/1992 | Kondo et al. | 362/541 |

(Continued)

FOREIGN PATENT DOCUMENTS

| | | |
|---|---|---|
| EP | 0606006 A | 7/1994 |
| EP | 0760448 | 3/1997 |

(Continued)

OTHER PUBLICATIONS

Patent Abstracts of Japan, vol. 2002, No. 10, Oct. 10, 2002, Moriyama Sangyo KK, Publication No. 2002163907, Publication Date: Nov. 24, 2000 "Light System and Lighting Unit".

(Continued)

*Primary Examiner* — Mary McManmon
(74) *Attorney, Agent, or Firm* — Koppel, Patrick, Heybl & Philpott

(57) ABSTRACT

An elongated perimeter light comprising an array of light sources that are illuminated by electric power. An elongated tube is included having a lumen along its length, with the tube being substantially solid except for the lumen. A blocking element covers a lower portion of the tube along its length, with the blocking element blocking light emission from the lower portion. The array of light sources is arranged within the lumen and transmits light through the tube and from an upper surface of the tube. The tube disperses the light from the array giving the appearance that the array of light sources is a continuous light source. The array of light sources is cuttable at intervals to shorten the array while allowing the remaining light sources in the resulting cut pieces to emit light. The tube and blocking element are cuttable to match the length of the array.

44 Claims, 12 Drawing Sheets

U.S. PATENT DOCUMENTS

| | | | | |
|---|---|---|---|---|
| 5,440,460 | A * | 8/1995 | Melberg | 362/101 |
| 5,559,681 | A | 9/1996 | Duarte | 362/252 |
| 5,879,076 | A | 3/1999 | Cross | 362/555 |
| 6,186,645 | B1 | 2/2001 | Camarota | 362/249 |
| 6,283,612 | B1 | 9/2001 | Hunter | 362/240 |
| 6,371,637 | B1 * | 4/2002 | Atchinson et al. | 362/555 |
| 6,406,166 | B1 | 6/2002 | Ko | 362/249 |
| 6,511,206 | B1 | 1/2003 | Fan Wong et al. | 362/250 |
| 6,592,238 | B2 | 7/2003 | Cleaver et al. | 362/249 |
| 6,609,813 | B1 * | 8/2003 | Showers et al. | 362/240 |
| 6,659,623 | B2 * | 12/2003 | Friend | 362/249.06 |
| 6,676,284 | B1 * | 1/2004 | Wynne Willson | 362/555 |
| 6,761,472 | B1 | 7/2004 | Cleaver et al. | 362/267 |
| 6,776,504 | B2 | 8/2004 | Sloan et al. | 362/240 |
| 6,834,979 | B1 | 12/2004 | Cleaver et al. | 362/219 |
| 6,948,828 | B1 * | 9/2005 | Chambers et al. | 362/219 |
| 6,953,262 | B2 | 10/2005 | Cleaver et al. | 362/219 |
| 7,011,421 | B2 | 3/2006 | Hulse et al. | 362/84 |
| 7,018,067 | B2 * | 3/2006 | Wu | 362/249.04 |
| 7,188,970 | B2 | 3/2007 | Cleaver et al. | 362/219 |
| 7,192,157 | B2 | 3/2007 | Sloan et al. | 362/216 |
| 7,192,161 | B1 | 3/2007 | Cleaver et al. | 362/260 |
| 7,207,692 | B1 | 4/2007 | Hulse | 362/231 |
| 7,273,300 | B2 * | 9/2007 | Mrakovich | 362/249.01 |
| 2003/0048641 | A1 | 3/2003 | Alexanderson et al. | 362/470 |
| 2005/0007033 | A1 * | 1/2005 | Kan et al. | 315/291 |
| 2005/0092517 | A1 | 5/2005 | Fan | |
| 2005/0180162 | A1 * | 8/2005 | Fan | 362/555 |
| 2005/0190552 | A1 | 9/2005 | Sloan et al. | |
| 2006/0146531 | A1 * | 7/2006 | Reo et al. | 362/244 |
| 2007/0041220 | A1 * | 2/2007 | Lynch | 362/646 |
| 2007/0274084 | A1 * | 11/2007 | Kan et al. | 362/373 |
| 2008/0117630 | A1 * | 5/2008 | Durvasula et al. | 362/246 |

FOREIGN PATENT DOCUMENTS

| | | |
|---|---|---|
| WO | WO 9906759 A | 2/1999 |
| WO | WO 0107828 A | 2/2001 |
| WO | WO 2005106320 | 11/2005 |

OTHER PUBLICATIONS

Search Report and Written Opinion, Jun. 19, 2008.

PCT Preliminary Report on related PCT application No. PCT/US2008/003347, dated: Sep. 24, 2009.

* cited by examiner

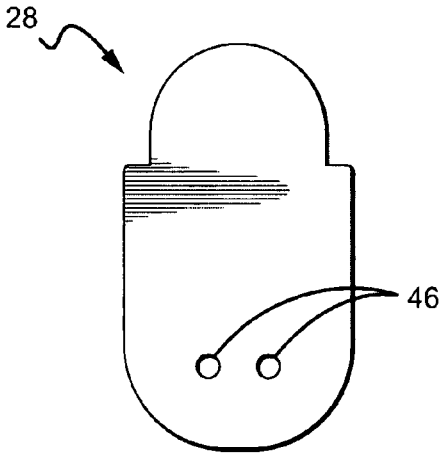
FIG. 7a
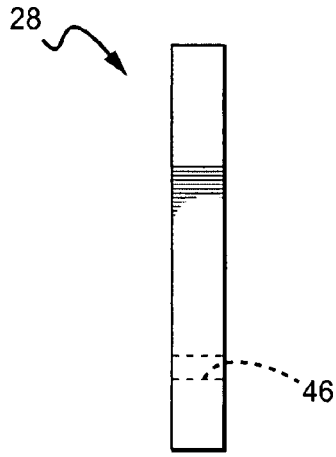
FIG. 7b
FIG. 8a
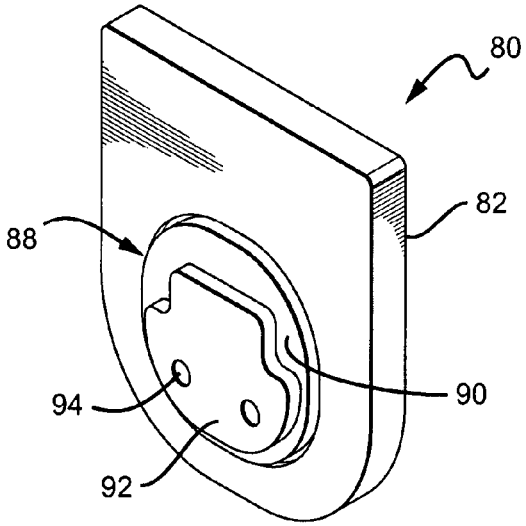
FIG. 8b
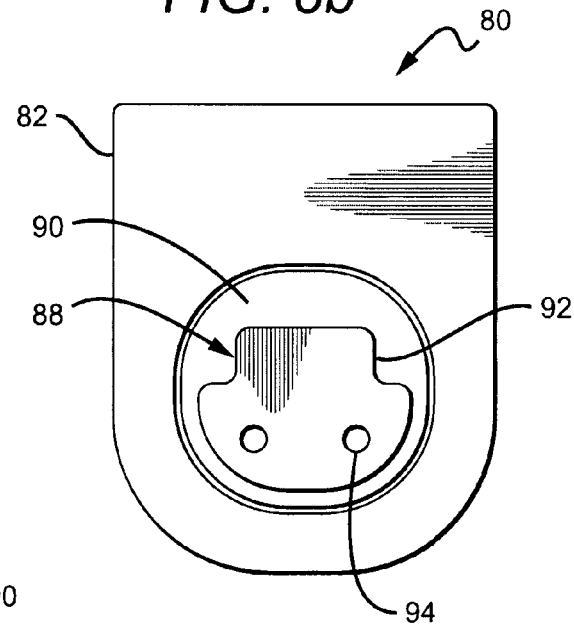
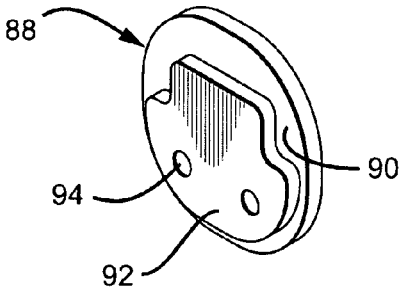
FIG. 8d FIG. 9d
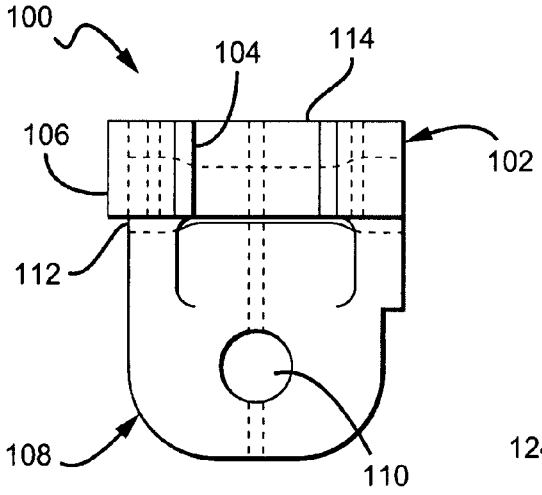
FIG. 10a
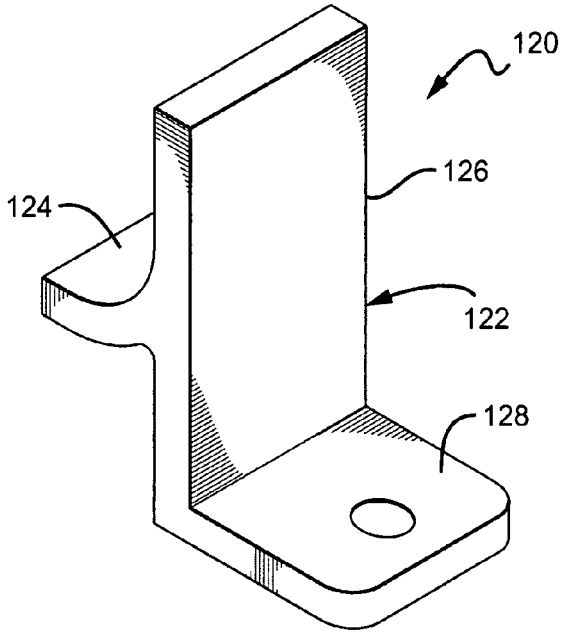
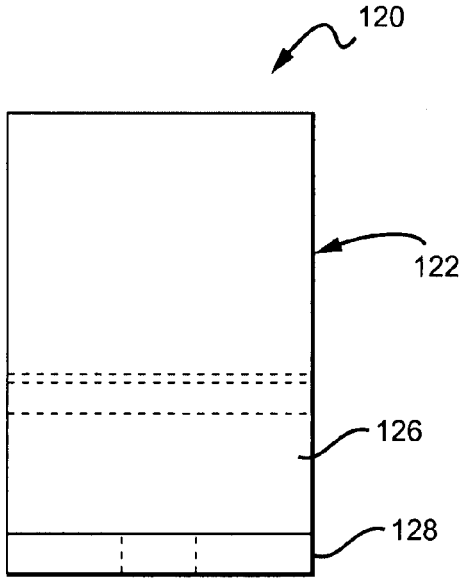
FIG. 10b
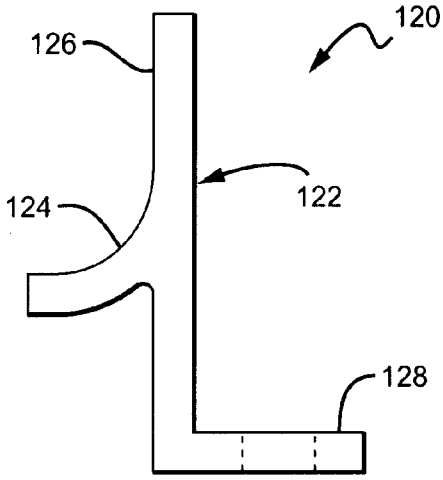
FIG. 10c

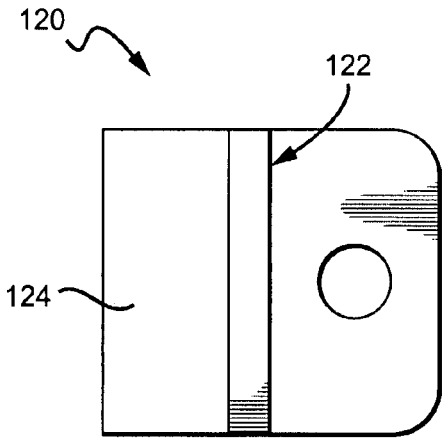
FIG. 10d
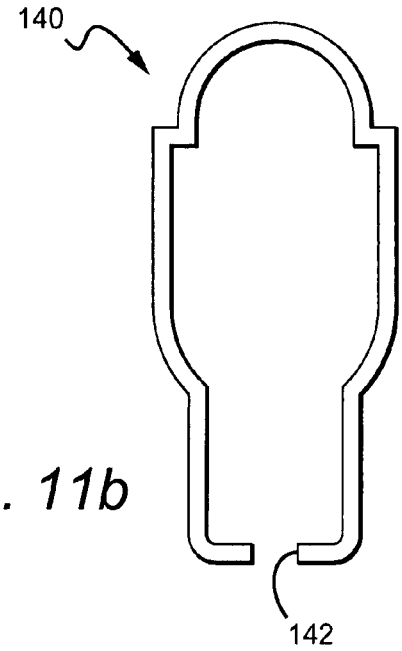
FIG. 11b
FIG. 11a
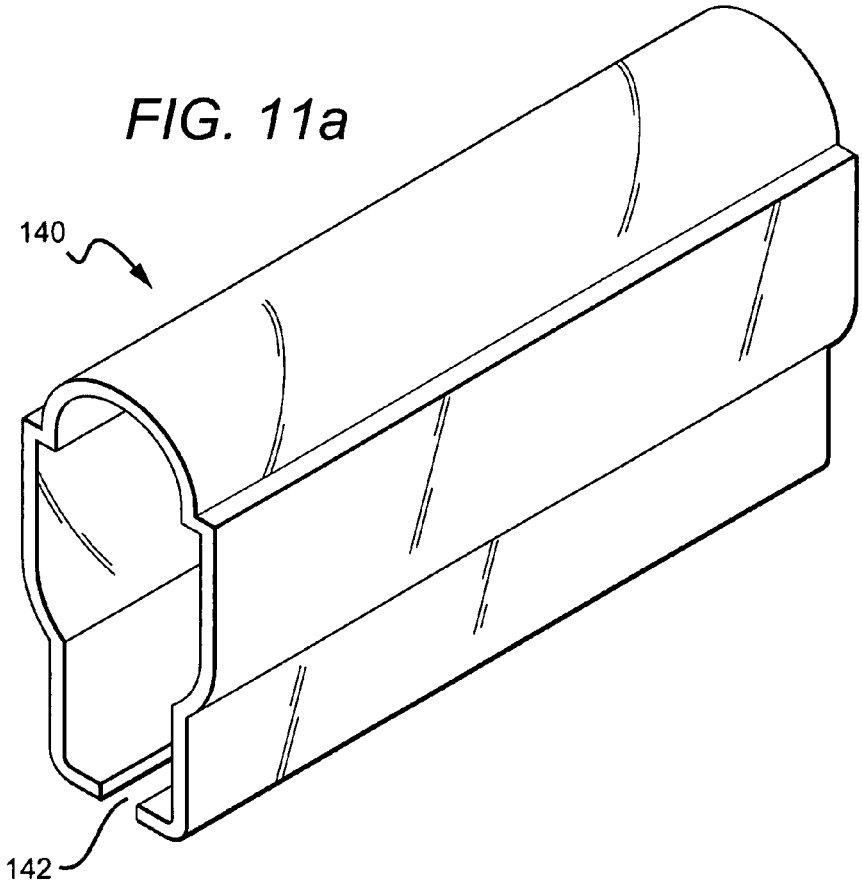

PERIMETER LIGHTING

This application is a continuation-in-part of and claims the benefit of U.S. patent application Ser. No. 11/100,087 filed on Apr. 5, 2005 now U.S. Pat. No. 7,448,768, which is a divisional of and claims the benefit of U.S. patent application Ser. No. 10/770,956 filed on Feb. 2, 2004 (now U.S. Pat. No. 6,969,179), which was a divisional of and claimed benefit of patent application Ser. No. 10/202,276 filed on Jul. 24, 2002 (now U.S. Pat. No. 6,776,504), which claims the benefit of U.S. provisional application No. 60/307,820 filed Jul. 25, 2001. This application also claims the benefit of U.S. Provisional Application No. 60/906,910 filed on Mar. 13, 2007.

BACKGROUND OF THE INVENTION

1. Field of the Invention

This invention relates to perimeter or border lighting for buildings and more particularly to perimeter or border lighting using light emitting diodes as the light source.

2. Description of the Related Art

Perimeter or border lights ("perimeter lights" or "perimeter lighting") are commonly used on buildings to accentuate the structure, to draw customer attention to the building, and to provide safety lighting. Most conventional perimeter lights use neon bulbs for the light source. Some of the disadvantages of neon lighting is that neon bulbs have a relatively short life, are fragile and can consume a relatively large amount of power. Also, neon bulbs can experience difficulty with cold starting, which can lead to the bulb's failure.

Developments in light emitting diodes ("LEDs") have resulted in devices that are brighter, more efficient and more reliable. LEDs are now being used in many different applications that were previously the realm of incandescent bulbs; some of these include displays, automobile taillights and traffic signals. As the efficiency of LEDs improves, it is expected that they will be used in most lighting applications.

U.S. Pat. No. 4,439,818 to Scheib discloses a lighting strip that utilizes LEDs as the light source. The strip is flexible in three dimensions and is useful in forming characters and is capable of providing uniform illumination regardless of the characters selected for display. The strip comprises a flexible multi-layered pressure sensitive adhesive tape, having a plurality of triangle cutout sections on each side of the tape, with LEDs connected in a series with a resister. One disadvantage of this strip is that it cannot be cut to different lengths for different applications. Instead, different lengths of the strip must be used. Further, the light from the LEDs is not diffused to give the appearance of neon light. This arrangement is not durable enough to withstand the conditions for outdoor use. The flexible tape and its adhesive can easily deteriorate when continually exposed to the elements.

U.S. Pat. No. 5,559,681 to Duarte discloses a flexible, self adhesive, light emissive material that can be cut into at least two pieces. The light emissive material includes a plurality of light electrically coupled light emissive devices such as light emitting diodes. The material also includes electric conductors for conducting electric power from the source of electric power to each of the light emissive devices. While this lighting arrangement is cuttable to different lengths, the light it emits is not dispersed so that it resembles neon light. This arrangement is also not durable enough to withstand the conditions for outdoor use. The flexible tape and its adhesive can easily deteriorate.

LEDs have been used in perimeter lighting applications. PCT International Application Number PCT/AU98/00602 discloses perimeter light that uses LEDs as its light source and includes a light tube structure in which multiple LEDs are arranged within an elongated translucent tube that diffuses or disperses the light from the LEDs. The perimeter light is used to highlight or decorate one or more features of a structure, such as a roof edge, window, door or corner between a wall or roof section. This light apparatus, however, cannot be cut to match the length of a building's structural features. Instead, the perimeter lighting must be custom ordered or it is mounted without fully covering the structural feature. Also, the connectors between adjacent sections of lighting are bulky and result in a visible junction between the sections. In addition, the light's tube significantly attenuates the light emitted by its LEDs, significantly reducing the light's brightness. Further, the light does not include a mechanism for compensating for the expansion and contraction between adjacent lights.

SUMMARY OF THE INVENTION

The present invention generally provides an improved elongated perimeter light that uses and array of light sources, such as light emitting diodes (LEDs), as its light source. The perimeter light can be connected in series with other perimeter lights, with each of the lights capable of being cut in the field to match the length of the structural feature.

One embodiment of an elongated perimeter light according to the present invention comprises an array of light sources that are illuminated by electric power. An elongated tube is included having a lumen along its length, with the tube being substantially solid except for the lumen. A blocking element covers a lower portion of the tube along its length, with the blocking element blocking light emission from the lower portion. The array of light sources is arranged within the lumen and transmit light through the tube and from an upper surface of the tube. The tube disperses the light from the array giving the appearance that the array of light sources is a continuous light source. The array of light sources is cuttable at intervals to shorten the array while allowing the remaining light sources in the resulting cut pieces to emit light. The tube and blocking element are cuttable to match the length of the array.

One embodiment of a system for lighting structural features according to the present invention comprises a plurality of elongated perimeter lights. Each of the perimeter lights comprises an array of semiconductor light emitters that are illuminated by electric power. An elongated tube is included having a lumen along its length, with the tube being substantially solid except for the lumen. A blocking element blocks light emitting from a portion of the tube, wherein the tube, the blocking element and array of light sources are cuttable at intervals to shorten the perimeter light. The plurality of perimeter lights are electrically coupled in a daisy-chain with the electrical power at each of the plurality of perimeter lights transmitted to the successive of the plurality of perimeter lights. A mechanism is included for mounting the plurality of perimeter lights to a structure.

These and other further features and advantages of the invention will be apparent to those skilled in the art from the following detailed description, taken together with the accompanying drawings, in which:

BRIEF DESCRIPTION OF THE DRAWINGS

FIG. 7*a* is a front elevation view of one embodiment of a bumper according to the present invention;

FIG. 7*b* is a side elevation view of the bumper in FIG. 7*a;*

FIG. 8*a* is a perspective view of another embodiment of a bumper according to the present invention;

FIG. 8*b* is a front elevation view of the bumper shown in FIG. 8*a;*

FIG. 8*d* is a perspective view of another portion of the bumper shown in FIG. 8*a;*

FIG. 9*d* is a top view of the mounting bracket in FIG. 9*a;*

FIG. 10*a* is a perspective view of one embodiment of an anchoring bracket according to the present invention;

FIG. 10*b* is a front elevation view of the anchoring bracket in FIG. 10*a;*

FIG. 10*c* is a side elevation view of the mounting bracket in FIG. 10*a;*

FIG. 10*d* is a top view of the mounting bracket in FIG. 10*a;*

FIG. 11*a* is a perspective view of one embodiment of a joint cover according to the present invention;

FIG. 11*b* is an end elevation view of the joint cover in FIG. 11*a;*

DETAILED DESCRIPTION OF THE INVENTION

Figure 1:
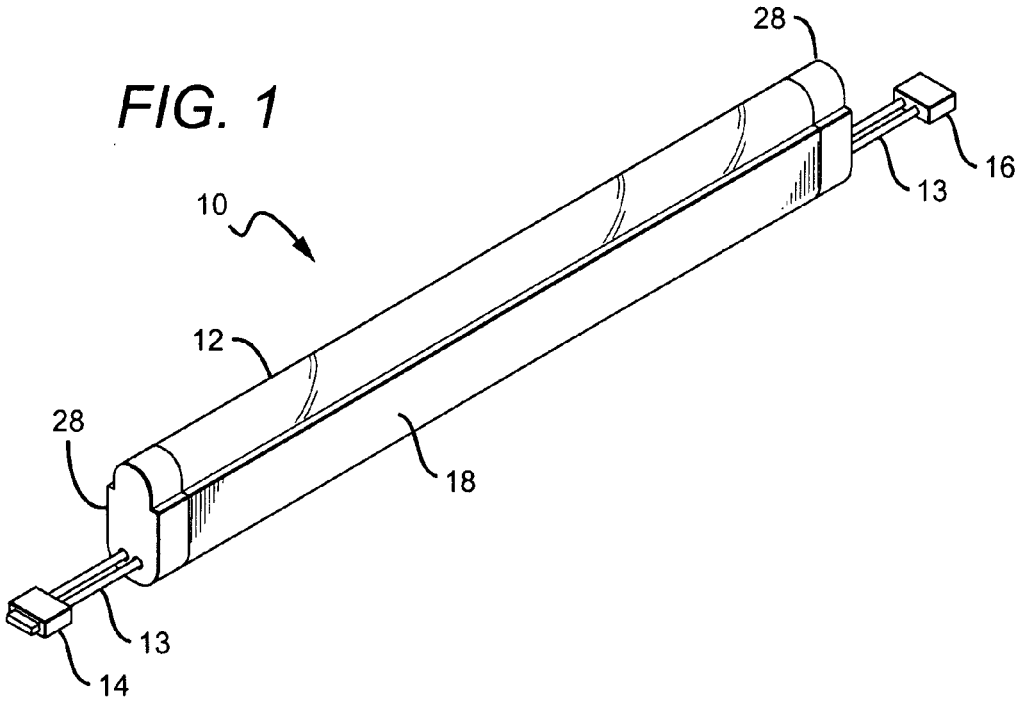
FIG. 1 is a perspective view of one embodiment of a perimeter light according to the present invention.

The present invention provides a perimeter light comprising a ridged tube with an array of lighting elements illuminating from inside the tube. Different lighting elements can be used with the preferred elements being light emitting diodes (LEDs). The tube is solid except for a lumen or bore running along its length, with the LEDs housed within the lumen. The LEDs can be arranged in different ways such as on a printed circuit board (PCB) The tube further comprises a blocking element covering its lower portion to block light from emitting from the covered portion. The light from the LEDs emits from an upper surface of the tube, with the LED light being dispersed as it passes from the lumen to the upper surface such that the tube appears as a continuous light source.

The perimeter light can be cut to match the length of structural features, with both the light sections left from the cutting being usable. More than one perimeter light can also be electrically connected in a daisy chain for illuminating longer structural features. The perimeter light can be sealed from water and contaminants, making it appropriate for indoor and outdoor uses. The perimeter light can also be bent during manufacturing to match curved structural features. The perimeter light is rugged compared to conventional neon lights and depending on the LEDs used, can be brighter than neon lights.

It is also understood that when an element is referred to as being "on", "adjacent", "connected to" or "coupled to" another element, it can be directly on, adjacent, connected to or coupled to the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the terms first, second, etc. may be used herein to describe various elements, components, and/or sections, these elements, components, and/or sections should not be limited by these terms. These terms are only used to distinguish one element, component, or section from another region, layer or section. Thus, a first element, component, or section discussed below could be termed a second element, component, or section without departing from the teachings of the present invention.

Embodiments of the invention are described herein with reference to cross-sectional view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes illustrated herein but are to include deviations in shapes that result, for example, from manufacturing. The figures are schematic in nature and their shapes are not intended to illustrate the precise shape of a region of a device and are not intended to limit the scope of the invention.

FIG. 1 shows one embodiment of a perimeter light 10 constructed in accordance with the present invention. It includes an elongated tube 12 that can have many different shapes and sizes, with a suitable shape being an oval shaped cross-section. The tube houses a PCB with LEDs in a linear array (see FIGS. 2 and 3). The tube can comprise many different materials but is preferably impact resistant and UV stable material such as acrylic. To provide the maximum light emission from the LEDs, the tube can have filter characteristics that transmit primarily the wavelength of light emitted from the LED array, while having materials to diffuse but not over-attenuate the emitting light. These characteristics allow the tube 12 to disperse the LED light as it passes from the LED lights through the tube material, to the emission surface of the tube. The emitted light gives the tube appearance of a continuous light source similar to neon lights.

Different materials can be used and can be included on the internal and external surfaces of the tube 12, and can be mixed in with the acrylic during manufacturing or both. The preferred tube has diffusing material mixed in during manufacturing with a material being particles of titanium dioxide ($TiO_2$). In other embodiments, commercially available micro-balloons or micro-spheres used as the diffusing material and can also be mixed in the acrylic during manufacturing. In still other embodiments the diffusing material can comprise acrylic frost, particles or shavings having a higher melting temperature than the tube material can be used as the diffusing material. Many different processes can be used to fabricate the tube 12, with the preferred process being extrusion.

The tube can be made of different colors of acrylic materials to match the wavelength of light being generated by the LEDs. For example, the tube can be made of red acrylic for transmitting light from red LEDs. In a preferred embodiment, the tube 12 can be made of a translucent acrylic such that the tube 12 can effectively transmit different colors of light. This allows for the same tube material to be used with many different colors of LEDs.

As mentioned above, the perimeter light 10 is arranged so that it can be attached with other perimeter lights in a daisy-chain when illuminating longer structural features. Different numbers of perimeter lights 10 can be connected together depending on factors such as the length of the light 10, the arrangement of the LEDs and other electronic components within the light, and the power produced by the particular power supply. In one embodiment, the light 10 is provided in 8 foot lengths such that three to four lights 10 can be daisy-chained together when powered by a conventional 12 volt, 5 amp power supply.

The light 10 has electrical conductors 13, such as commercially available insulated wires, that extend from each end and when connecting the lights in a daisy-chain the wires 13 from different lights should be connected so that electrical power can pass from one perimeter light to the other down the daisy-chain. Different connectors can be used and in the embodiment shown, a male connector 14 is provided at the end of the wires 13 on one end and a female connector 16 on the wires at its other end, both arranged so that multiple lights 10 can be electrically connected in series. Other embodiments can have the connector types reversed or can use different connectors. For example, the wires can be provided without connectors attached and the wires can be connected using commercially available connectors such as butt splices, wire nuts or insulation displacement connectors.

Referring now to FIGS. 1 through 4, a light blocking element 18 is provided that covers the outside lower portion of the tube 12 and is arranged to block light emitted through lower curved surface 20 and lower portion of the side surfaces 22, 24 of the tube 12. The blocking element 18 can also reflect light emitting through the lower surface 20 and side surfaces 22, 24, so that the light can emit out the primary upper curved surface 26. The tube 12 can be bonded to the element 18 using known bonding processes and materials. The element 18 can be made of many different materials that can block light, with suitable materials such as acrylics or polycarbonates. The element 18 preferably comprises one of these materials and can be many different colors with a preferred color being white. The element 18 can also be fabricated using known methods such as injection molding or extrusion.

The blocking element 18 can have many different shapes and sizes and in the embodiment shown has a U-shaped cross-section to match to lower portion of the tube 12. The lower portion of the element 18 can be shaped to have a flat surface to aid in stabilizing the light 10 when it is mounted to a structure. The element 18 can also be formed with mounting mechanisms such as brackets or adhesives to aid in mounting the light to a structure. In one such embodiment, the element 18 can be formed with a bracket having a screw hole. A screw can pass through the screw hole and into a structure for mounting the light 10. In other embodiments, the element 18 can be formed integral to the tube 12 during fabrication of the tube 12, instead of as a separate section bonded to the tube 12 in a separate step.

The tube 12 can also have many different shapes and sizes, with one embodiment of the tube having a shape and size to simulate conventional neon lighting. As more fully described below, the height of the tube can be such that light emitting from the tube is even and without lighting "hot spots".

Figure 2:
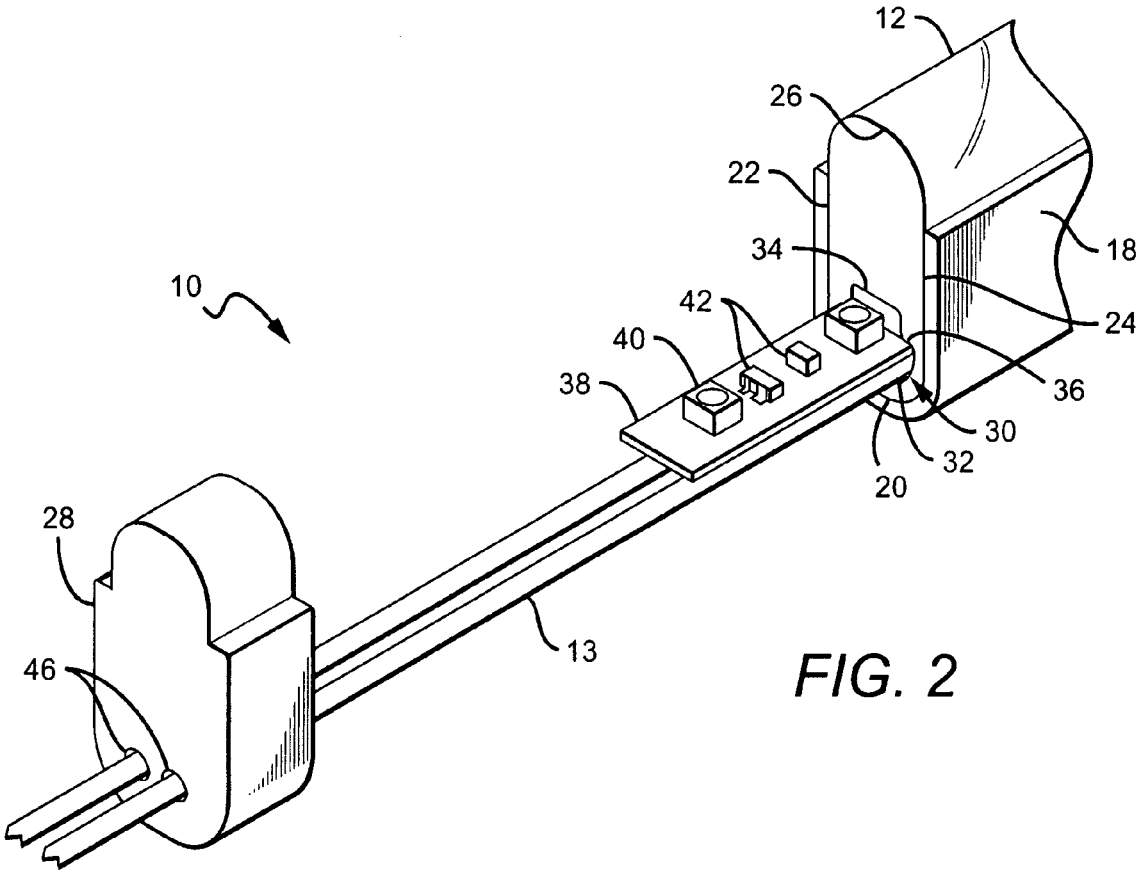
FIG. 2 is an exploded perspective view of the perimeter light shown in FIG. 1.

End bumpers 28 can be included on the perimeter light 10 as shown in FIGS. 1 and 2, to provide a protective seal at the ends of the tube 12 to protect the light's internal components. When one or more perimeter lights 10 are linearly connected, the end bumpers 28 can also compensate for expansion and contraction of the lights 10 from heat of the LEDs or from the ambient temperature. The bumpers 28 can also compensate for the different expansions between the tube 12 and internal components. As more fully described below, different embodiments of bumpers can be used. The preferred bumpers 28 are at least partially transparent such that light from the LEDs or tube passes into the bumpers. This causes them to glow and illuminate at the color of the perimeter light such that multiple connected perimeter lights 10 appear as one continuous light.

Figure 3:
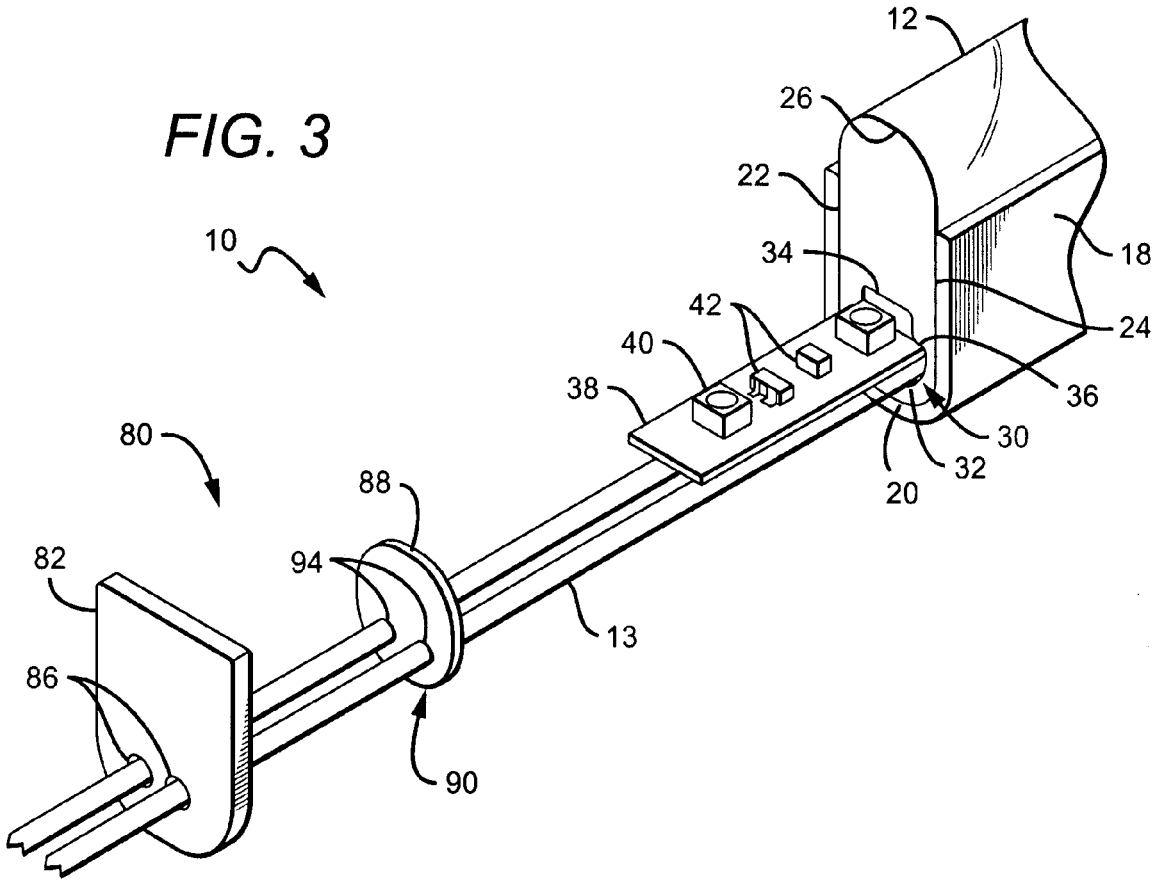
FIG. 3 is an exploded perspective view of another embodiment of a perimeter light according to the present invention.
Figure 4:
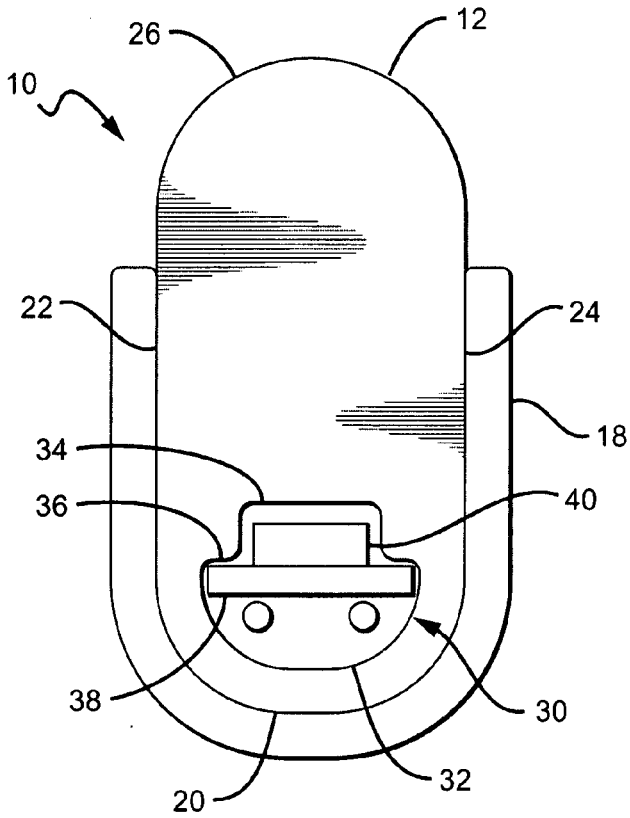
FIG. 4 is a sectional view of the perimeter light in FIG. 1 taken along section lines 4-4.

Referring now to FIGS. 2-4 the tube 10 as shown has a cross section in the form of an extended oval or racetrack shape, although other shapes can be used. The tube 10 is solid except for a lumen (or bore) 30 in its lower portion that extends along its length. The lumen can be located in different areas of the tube 10 and can have many different shapes and sizes. In the embodiment shown the cross-section of the lumen 30 includes a generally semi-circular lower portion 32 and a rectangular portion 34 extending upwardly from a diameter of the semi-circular portion 32. The rectangular portion 34 is somewhat shorter so as to define shoulders 36.

The light 10 further comprises an elongated PCB 38 arranged within the lumen 30. The PCB 38 is arranged to hold LEDs 40 that direct light through the tube 12 and out the upper curved surface 26. As mentioned above different light emitting elements can be used, with the preferred elements LEDs 40. Additional electronic components 42 can be included on the PCB 38 as further described below, with the LEDs 40 and components 42 mounted to the PCB using known methods, and interconnected using conductive traces on the PCB as is known in the art. In the embodiment shown, the LEDs 40 are preferably arranged on one side of the PCB 38 and linearly down the PCB's longitudinal axis, although the LEDs could be arranged in different locations. The LEDs can be spaced apart by different distances depending on the size and shape of the tube 12 and the luminous flux of the LEDs 40. The electronic devices 42 can comprise different component including but not limited to capacitors, resisters, diodes, and transistors.

The LEDs can be the same type emitting the same wavelength of light or the LEDs can comprise different LED emitting different wavelengths of light. In one embodiment having different LEDs 40, the emission of the LEDs 40 can be controlled such that the perimeter light emits different wavelength combinations of the light from the LEDs. The LEDs 40 can comprise red, green and blue emitting LEDs whose intensity can be controlled such that the perimeter light 10 emits different wavelength combinations, including white light. In other embodiments, the light can be controlled by a dimmer to vary the luminous flux of the LEDs 40 and the illumination brightness of the perimeter light 10. The LEDs 40 can comprise conventionally mounted devices with the LEDs 40 preferably being surface mount devices. Depending on the embodiments, the PCB 38 can be horizontal as shown or can be arranged vertically. In each arrangement the LEDs 40 are typically mounted to the PCB 38 with light directed through the tube and emitting from the upper curved surface 26 of the tube 12.

The lumen 30 is preferably sized to hold the printed circuit board between its surfaces without the need for adhesives or potting materials. In the embodiment shown, the shoulders 36 are adjacent to the upper surface of the PCB 38 with the curved surface of the semi-circle lower portion 32 being adjacent to the lower surface of the PCB 38. This results in the PCB being held in place between the shoulders 36 and the curved surface, while still allowing the PCB to slide longitudinally within the lumen 30. This arrangement not only allows for ease of manufacturing by sliding the PCB 38 within the lumen 30, but also allows different types of lights 10 to be manufactured from the same tube. That is, different PCBs with different LEDs arranged in different ways can be used with the same tube 12. This arrangement also allows for the tube 12 and PCB 38 to expand and contract at different rates during heating and cooling cycles.

The PCB 38 can be connected to a source of power in many different ways, and as shown in FIGS. 2 and 3, the wires run through the lumen 30, below the PCB 38 and in the semi-circle lower portion 32. The arrangement allows for the wires 13 to serve as an electrical bus through the light 10. The PCB 38 can be electrically coupled to the wires 13 by different methods such as soldering or insulation displacement connectors at one or more locations on the bus, with the electrical signal on the wires being transmitted to the LEDs 40 causing them to illuminate. This power bus arrangement allows for powering the LEDs 40 without the power signal being transmitted along PCB conductive traces before being transmitted to the next light in the daisy chain. This reduces the overall voltage drop as the signal is transmitted down the daisy-chain compared to signals transmitted through PCB traces. It is understood however that arrangement incorporating conductive traces can also be used.

The tube 12 is preferably sized and shaped such that light from the LEDs 40 emits from the upper curved surface 26 without lighting hot spots and giving the appearance of a continuous light source, while at the same time minimally attenuating the emitting light. The lumen 30 is located in the lower half of the tube 12, and in a preferred embodiment is located on the lower third of the tube 12. The lumen 30, however, is typically not located at the bottom of the tube 12, which allows the lumen 30 to be surrounded by tube material. In one embodiment, the tube is approximately 0.5 inches wide and 1 inch tall, with the lumen 30 in the lower third of the tube 12. In a typical embodiment, the tube can be approximately 0.438 inches wide and 0.930 inches tall, with the distance between the rectangular portion 34 of the lumen 30 and the upper curved surface 26 of the tube 12 being approximately 0.630 inches. This arrangement allows for light from conventional LEDs in the lumen to pass through sufficient tube material to disperse the light without over attenuation. The sides of the U-shaped blocking element 18 can extend up each of the side surfaces a sufficient distance to prevent visible hot spots.

Figure 5:
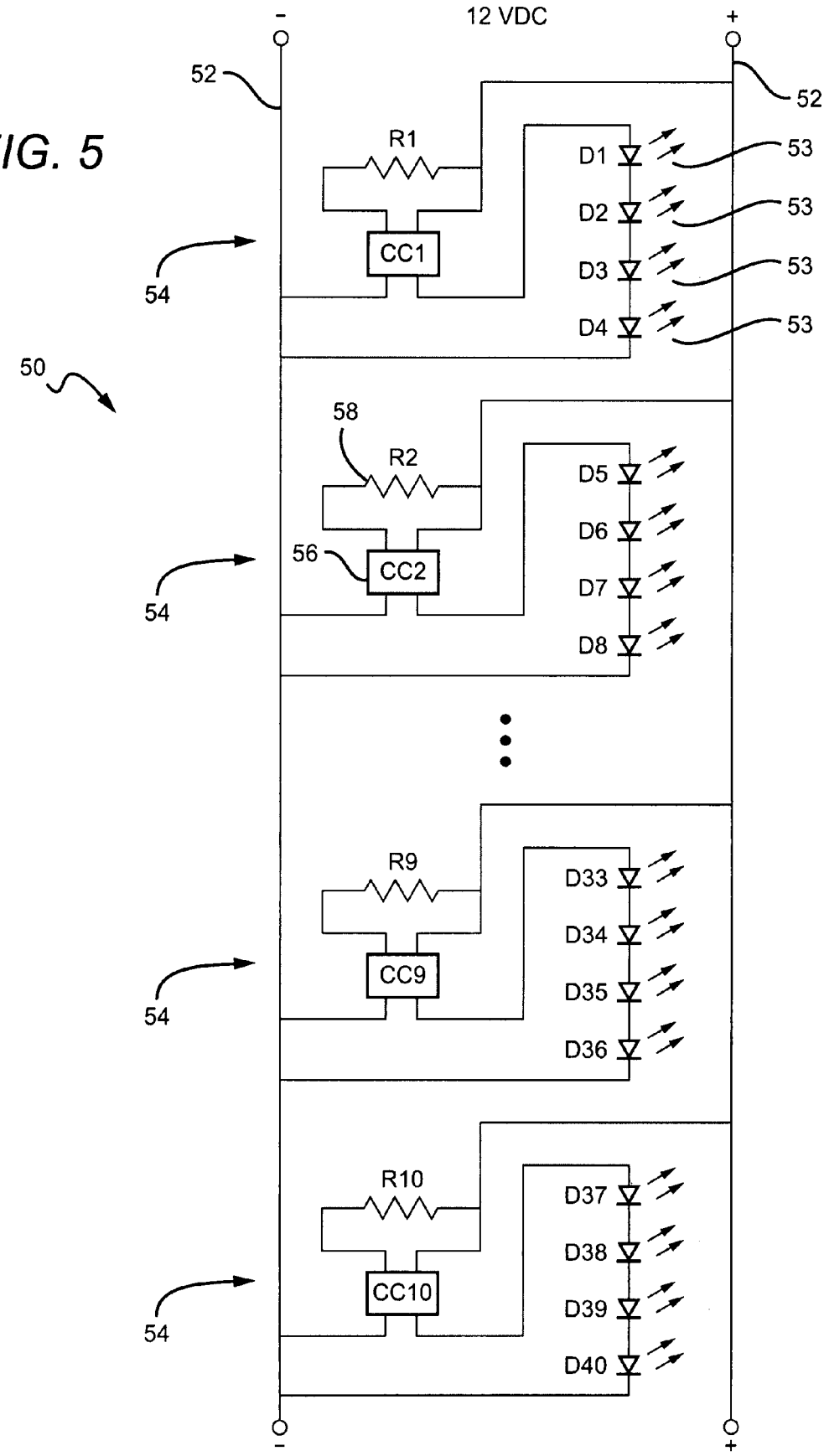
FIG. 5 is a schematic for one embodiment of the electronic elements and interconnects on a PCB according to the present invention.

FIG. 5 shows one embodiment of a circuit 50 comprising the components and interconnects provided on PCB 38. Power is supplied to the components along power bus 52 (corresponding to wires 13 described above) with the typical power signal being 12 volts. The circuit includes forty LEDs 53 divided into ten parallel sub-arrays 54 each of which has four LEDs connected between the wires of the bus 52. Each of the sub-arrays 54 also comprises a constant current device 56 and a resistor 58 that in combination result in the LEDs 53 in each of the sub-arrays being driven by substantially the same current. This allows for the light 10 to emit with substantially even illumination of the LEDs 53 along the length of the PCB. This arrangement provides for consistent illumination and reliability of the LEDs 53. Many different constant current devices can be used, with a suitable device being an LM317M 3-Terminal Adjustable Regulator provided by Texas Instruments, National Semiconductor, and Fairchild Semiconductor.

The arrangement of circuit 50 is particularly applicable to use with LEDs emitting in the "warm" wavelength spectrum, such as red or orange. These LED types typically result in a voltage drop of approximately 2.2 volts during operation, so four LEDs connected across the wires of the bus equates to a voltage drop of approximately 8.8 volts. Accordingly, there is sufficient voltage from the power bus to illuminate the four LEDs in each of the sub-arrays 54, while still having sufficient voltage to drive the other components such as the constant current device 56.

As mentioned above, one of the advantages of the new perimeter light 10 is that it can be cut to match the length of a particular structural feature. The light 10 can be cut at different locations down the length of the PCB corresponding to the locations in the circuit 50 between adjacent ones of the sub-arrays 54. Following cutting, both of the lengths can be used. For example, if the circuit were cut between the first sub-array 54 and the second of the sub-arrays 54, the section with the first of the sub-arrays 54 could be illuminated by applying an electrical signal to section of the power bus 52 remaining with the first of the sub-arrays 54. Similarly, the section with the second through tenth of the sub-arrays 54 could be illuminated by applying an electrical signal to the remaining power bus 52. In one embodiment, the PCB is approximately two feet long and has five sub-arrays 54 per foot. This allows for the perimeter light and its PCB to be cut in five different equally spaced locations per foot. For perimeter lights that are longer than two feet, multiple PCBs can be used.

The perimeter light 10 can also be marked along its length to indicate the location for cutting between sub-arrays 54, with the preferred light 10 having marks on the underside of the blocking element 18. This hides the cutting marks from view when the light 10 is mounted to a structure.

Figure 6:
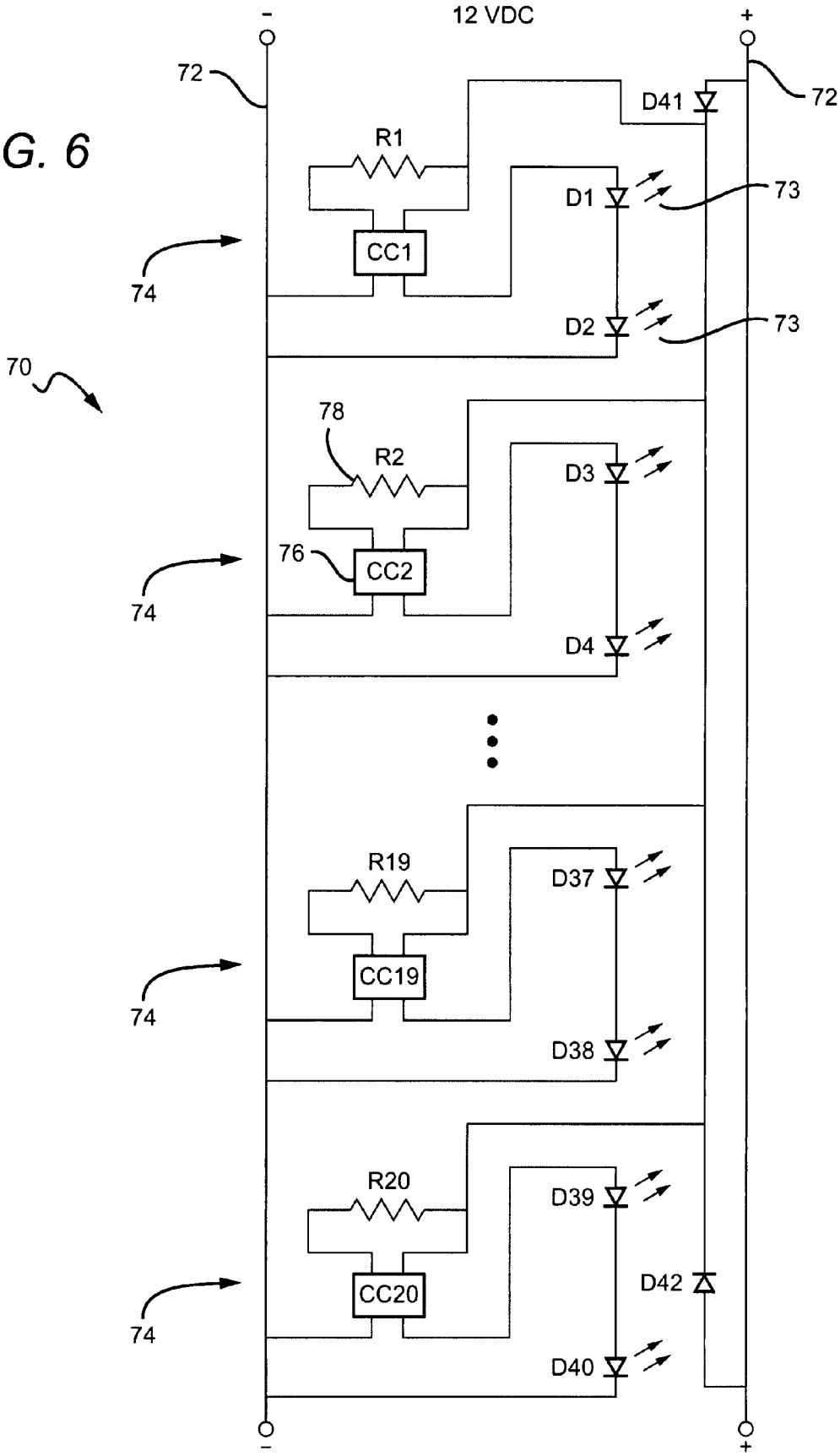
FIG. 6 is a schematic for another embodiment of the electronic components and interconnects on a PCB according to the present invention.

FIG. 6 shows another embodiment of a circuit 70 comprising the components and interconnects provided on PCB 38. Like the circuit 50 described above power is supplied to the components along power bus 72 (corresponding to wires 13 described above) with the typical power signal being 12 volts with 5 amps. The circuit also includes forty LEDs 73 divided into twenty parallel sub-arrays 74, each of which has two LEDs connected between the wires of the bus 72. Each of the sub-arrays also comprises a constant current device 76 and a resistor 78 similar to the device 56 and resistor 58 described above.

The arrangement of circuit 70 is particularly applicable to use with LEDs emitting in the "cool" wavelength spectrum, such as blue or white. Each of these types of LEDs typically result in a voltage drop of approximately 3.5 volts during operation, so two LEDs connected across the wires of the bus equates to a voltage drop of approximately 7 volts. Accordingly, there is sufficient voltage from the power bus to illuminate the two LEDs in each of the sub-arrays 74, while still having sufficient voltage to drive the other components such as the constant current device 76.

The circuit 70 can also be cut between adjacent sub-arrays 74, with both resulting lengths being usable by applying an electrical signal to the respective remaining section of the power bus 72. The light 10 can also be marked along its length corresponding to the locations to cut the light 10 between sub-arrays 74. The circuit 70 typically comprises ten sub-arrays 74 per foot on a two foot PCB. The perimeter light and its PCB can be cut at ten equally spaced locations per foot.

Lights according to the present invention can be provided with end caps to protect the PCB and its components from water and contaminants. Referring to FIG. 2, along with FIGS. 7*a* and 7*b*, an end cap 28 is shown that has a shape similar to the cross-section of the light 10. The end cap 28 can be made of many different materials that are UV stable, resilient and durable, with a preferred material being silicone. The end cap can also have many different thicknesses, with a suitable thickness being approximately 1 inch.

The end cap 28 has two holes 46 for wires 13, and in the preferred embodiment the holes are sized to provide a watertight seal with the wires without the need for adhesive or sealing materials. The end cap 28 can be bonded in place at the end of the light 10 using known adhesive materials to provide a watertight bond between the end cap 28 and the light 10. The surface of the end cap 28 abutting the light 10 provides a relatively large bonding surface area and should be arranged such that light passes into the end cap 28 from the light 10. When the lights 10 are arranged in a daisy-chain the end cap 28 provides a compression zone to compensate for expansion and contraction of the lights 10 during heating and cooling cycles. Light transmitting into the end cap 28 gives the daisy-chained lights the appearance of continuous light source. That is, the bleed over of light into the end caps 28 disguises the break between adjacent lights.

Figure 8C:
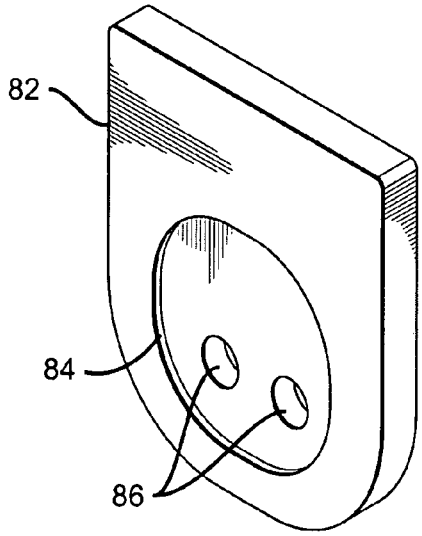
FIG. 8*c* is a perspective view of one portion of the bumper shown in FIG. 8*a;*
Figure 9A:
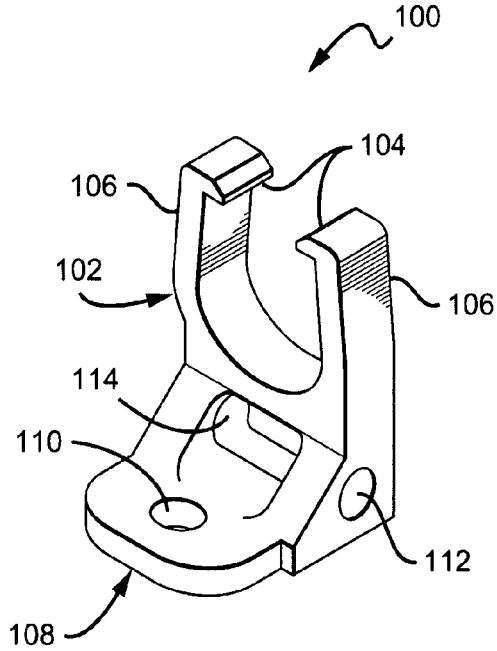
FIG. 9*a* is a perspective view of one embodiment of a mounting bracket according to the present invention.
Figure 9B:
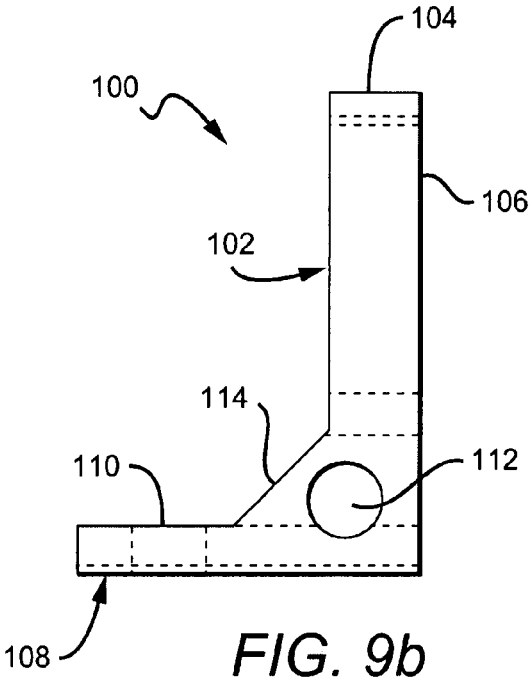
FIG. 9*b* is a side elevation view of the mounting bracket in FIG. 9*a;*
Figure 9C:
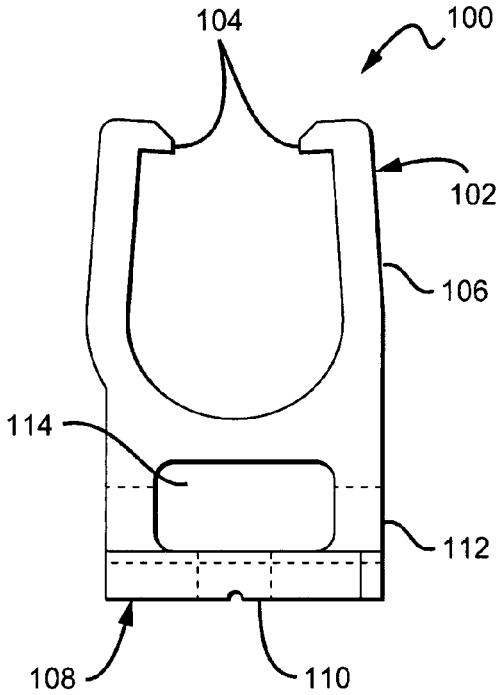
FIG. 9*c* is a front elevation view of the mounting bracket in FIG. 9*a;*

Another embodiment of an end cap 80 according to the present invention is shown in FIG. 3 along with FIGS. 8*a* through 8*d*. The end cap 80 comprises two different sections made of different materials; one being resilient the other being rigid. The rigid section 82 is generally sized and shaped to fit the end of the light 10 or sized similar to the U-shape cross-section of the blocking element 18. This portion of the end cap 80 can be made of many different materials, but is preferably made of acrylic. The rigid section 82 provides a large bonding surface that allows for efficient bonding to the light's tube 12 and blocking element 18 using known bonding techniques. As best shown in FIG. 8*c* the rigid section comprises a recess 84 having holes 86 for the wires 13 (best shown in FIG. 3) to pass.

The end cap 80 further comprises a resilient sealing portion 88 that can be made of many different materials, but is preferably made of silicone. The sealing portion has a disk shaped back 90 sized to fit in the recess 84, and a front sized to fit in the lumen 30. The sealing portion 88 has sealing portion holes 94 for the wires 13 to pass with a close fit such that a watertight seal is made between the wires and the holes. Alternatively, sealing materials can be included around the wires to create a watertight seal. The back is bonded into the recess 84 using known bonding techniques, and when the end cap is bonded to the end of the light 10, the front portion provides a watertight seal at the opening of the lumen 30. In other embodiments, fasteners can be included alone or in combination with an adhesive, to fasten the end cap to the end of the light 10.

The present invention can also comprise different mechanisms for firmly and reliably mounting the light to a body or structure. FIGS. 9*a* to 9*d* show one embodiment of a mounting bracket 100 according to the present invention that is mounted to a body or structure, with the perimeter light 10 (FIGS. 1-3) then mounted within the bracket 100. The bracket 100 comprises and upper U-shaped clamp 102 having opposing tabs 104 at the ends of the legs 106. One or more of the legs 106 are not vertical, but are angled inward. This allows for the clamp to hold the light as more fully described below.

The clamp 102 further comprises a mount 108 that is substantially perpendicular to the clamp 102 and is arranged to be held adjacent to a structure, with the clamp 102 projecting away from the structure. The mount 108 can be affixed to a structure using known methods and materials, such as adhesives, nails, and clamps, with the preferred method being by screws. The mount has a screw hole 110 arranged so that a screw (not shown) can pass though and turn into the structure. When the screw is tightened into the structure, the bracket is firmly mounted to the structure. More than one bracket 100 can be used for mounting a light according to the present invention. When the brackets are mounted, the perimeter light 10 (shown in FIG. 1) can be pushed into the clamp 102 with the blocking element 18 first, causing one or more of the legs 106 to flex out. As the blocking element 18 reaches the bottom of the clamp 102, the tabs 104 pass the top of the blocking element 18, allowing the legs 106 to snap back with the tab over the top edge of the blocking element 18. The tabs 104 firmly hold the light within the clamp 102 while at the same time allowing for movement due to expansion and contraction of the light during heating and cooling cycles.

The bracket 100 can be made of many different materials, with the preferred material being clear and UV stable. The preferred bracket comprises a commercially available clear polycarbonate. The bracket 100 allows for lights to be mounted vertical or horizontal, as well as for edge mounting or frame mounting. Most of the bracket 100 is hidden from view behind the light, giving the appearance of convention neon type mounting brackets.

The bracket 100 also comprises additional features such as a tie down hole 112 that allows for a tie-down to pass through and wrap around the light to further hold the light within the bracket 100. Different tie downs can be used, with the preferred tie down being a ladder tie made of a white or substantially transparent material. The bracket 100 further comprises a channel 114 for wires, such as power wires, to run behind the light where they are hidden from view. The bracket 100 further comprises a bottom longitudinal groove that can be lined up with a mark or chalk line during installation to center the bracket 100 for mounting. This helps align multiple brackets along a single mark or line.

During expansion and contraction, some perimeter lights can move with the brackets and "walk" up or down the brackets during these cycles. Referring now to FIGS. 10*a* to 10*d*, an anchoring bracket 120 can be provided to hold the perimeter lights within the brackets through these cycles. The anchoring bracket generally comprises a bonding portion 122 and a mount 128, with the bonding portion having a shaped surface 124 to substantially match the outside surface of the blocking element 18. The bonding portion 122 also has an extension 126 that is substantially perpendicular to the mount 128.

The anchoring bracket can also be made of many different materials, with the preferred material being a clear UV stable polycarbonate. The anchoring bracket 120 can be mounted to a structure with the surface 124 adjacent to the blocking element, near the center of the light. The surface 124 can then be bonded to the blocking element using conventional acrylic or polycarbonate bonding materials. The anchoring bracket 120 holds the light in place while still allowing for expansion and contraction of the light in the other brackets holding the light, such as bracket 100 described above. The anchor bracket prevents its light from "walking" up or down the mounting brackets through temperature cycles.

Referring now to FIGS. 11*a* to 11*d*, a joint cover 140 can be included over the break between adjacent perimeter lights. The joint cover 140 has a cross-section to substantially match that of the perimeter light described above. The joint covers are arranged to protect all the lighting joints or breaks, but are particularly applicable to butt joints between light. The lower portions of the joint cover 140 can spread along the lower longitudinal opening 142 and the joint cover can be placed over the joint. The lower portions can then snap back in place to hold the cover to the adjacent lights, over the butt joint. An adhesive can be included to hold the cover 140 in place. The cover 140 can comprise many different materials with the preferred material being acrylic that is either clear or frosted. It is understood that different covers can be provided to be placed over different angles between adjacent lights. For example, a 90 degree joint cover can be provided to cover a 90 degree joint between adjacent lights.

Perimeter lights according to the present invention can also be bent to different radiuses during manufacturing to match curved structural features. Different processes can be used for bending the perimeter lights including but not limited to those disclosed in U.S. Pat. No. 7,192,157 to Sloan et al. (assigned to SloanLED, Inc.) entitled "Method for Fabricating a Bent Perimeter Light", which is incorporated herein by reference. The perimeter light described herein can be bent to radiuses of eight inches or smaller, and in some embodiments the PCB can be segmented to facilitate bending of the perimeter light.

The ends of the perimeter light can also be cut at different angles to match the different angles of structural features, and in some embodiments compound angles can be used. In these embodiments silicone interfaces can be injected between the angles to seal the lumen and to provide a compression zone for expansion and contraction. Clear silicone is preferably used such that the apex of the corner illuminates at the same color as the perimeter lights.

Figures 12A, 12B, 12C, 12D:
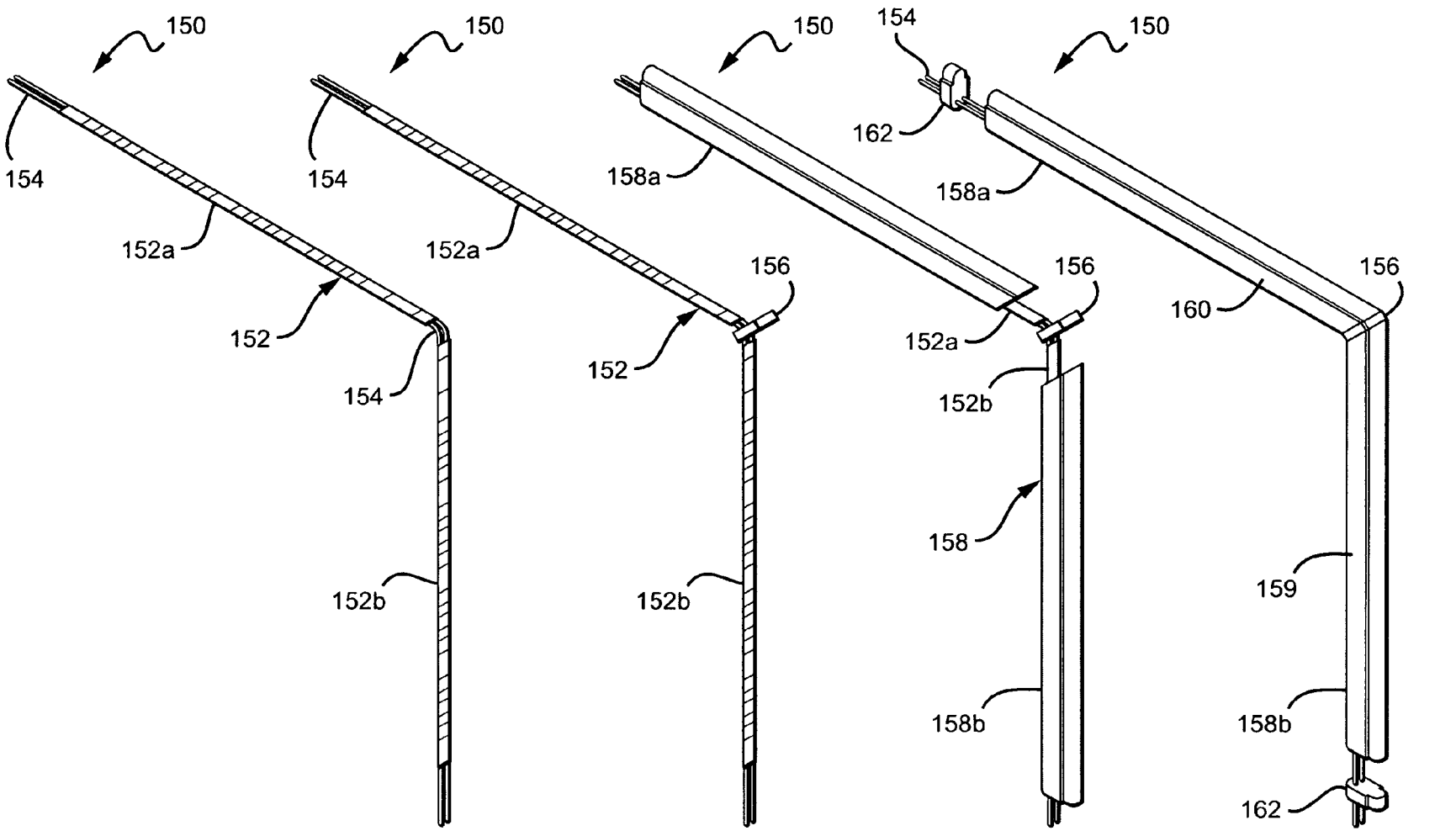
FIG. 12*a* is a perspective view of a printed circuit board (PCB) utilized in one embodiment of an angled perimeter light according to the present invention.
FIG. 12*b* is perspective view of the PCB in FIG. 12*a*, with a center plug.
FIG. 12*c* is a perspective view of the PCB in FIG. 12*b* with tube sections.
FIG. 12*d* is a perspective view of the of the PCB and tube combination in FIG. 12*c*, with end bumpers'

Perimeter lights according to the present invention can also be fabricated at different angles to match corners in structural features, and can be arranged with conductors for connecting with other perimeter lights in a daisy-chain. FIGS. 12*a-e* show one embodiment of an angled perimeter light 150 according to the present invention fabricated at a 90 degree angle for mounting to an "outside" corner of a structural feature. Referring to FIG. 12*a*, the angled light 150 can be fabricated using many different methods and in a preferred method the light's PCB 152 can be cut into first and second sections 152*a*, 152*b*. The PCB 152 can be cut in different locations, but is typically cut near a center point. The wire bus 154 is not cut and the PCB is cut back such that there is space between the opposing ends of the cut PCB, with the wire bus 154 running between the ends. Wire jumpers (not shown) can then be attached across the space between the PCB sections 152*a*, 152*b* to connect the conductive traces. As best shown in FIG. 12*b*, center plug 156 is placed between the PCB sections 152*a*, 152*b*, with the wire bus 154 and jumpers running through holes in the center plug 156. The center plug 156 can comprise many different materials and can have many different shapes with the plug providing a resilient or flexible interface between the rigid tube sections as described below. Many different UV stable, flexible and substantially transparent materials can be used for the center plug 156, with the preferred center plug 156 being made of silicone. In other embodiments, the plug can comprise a liquid between the tube sections that can later be cured. The center plug 156 preferably forms a watertight seal with the wire bus 154 and jumpers, and provides a compression zone during expansion and contraction of the light sections during thermal cycles.

Referring now to FIG. 12*c*, a light tube 158 is provided that is similar to the tube 12 described above and can be made of the same material. It also comprises a blocking element 159 that is similar to the blocking element 18 described above and can be made of the same material. In this embodiment, however, the tube is cut into first and second tube sections 158*a*, 158*b* with one end of each of the sections cut at an angle to allow the tube sections 158*a*, 158*b* to be at a 90 degree angle when they are arranged end-to-end. The tube's mounting surface 160 is on the inside of the 90 degree angle. Each of the tube sections 158*a*, 158*b* is slid over a respective one of the PCB sections 152*a*, 152*b* with each of the PCB sections 152*a*, 152*b* being housed in the tube lumen. The angle cut end of each of the tube sections 158*a*, 158*b* is arranged adjacent to the center plug 156 and bonded to the center plug 156 using conventional bonding materials. A watertight seal is preferably formed between the center plug 156 and the tube sections 158*a*, 158*b*.

As mentioned above, the center plug 156 is preferably made of a resilient (flexible) material which allows some range of flexibility when mounting the light 150 to a structural feature such that the light can be mounted to structural features within a range of angles. Although the light is arranged to fit on a 90 degree structural feature, if the structural feature is not fabricated to precisely 90 degrees, the center plug 156 allows the light some flexibility so that it can be manipulated to match the imprecise structural feature. For example, if the structural feature is 93 degrees, instead of 90 degrees, the plug 156 allows the angle of the light to be increased while maintaining the watertight seal at the interface.

As shown in FIG. 12*d*, bumpers 162, similar to bumper 28 described above and shown in FIGS. 1 and 2, can be bonded to the ends of the tube section 158*a*, 158*b*. The light 150 can be mounted around a 90 degree structural feature using the mounting brackets 100 and/or anchoring brackets 120 described above. Additional straight or angled perimeter lights can be electrically coupled to the perimeter light 150 at the wire be extending from the bumpers 162.

Figures 12E, 13A, 13B:
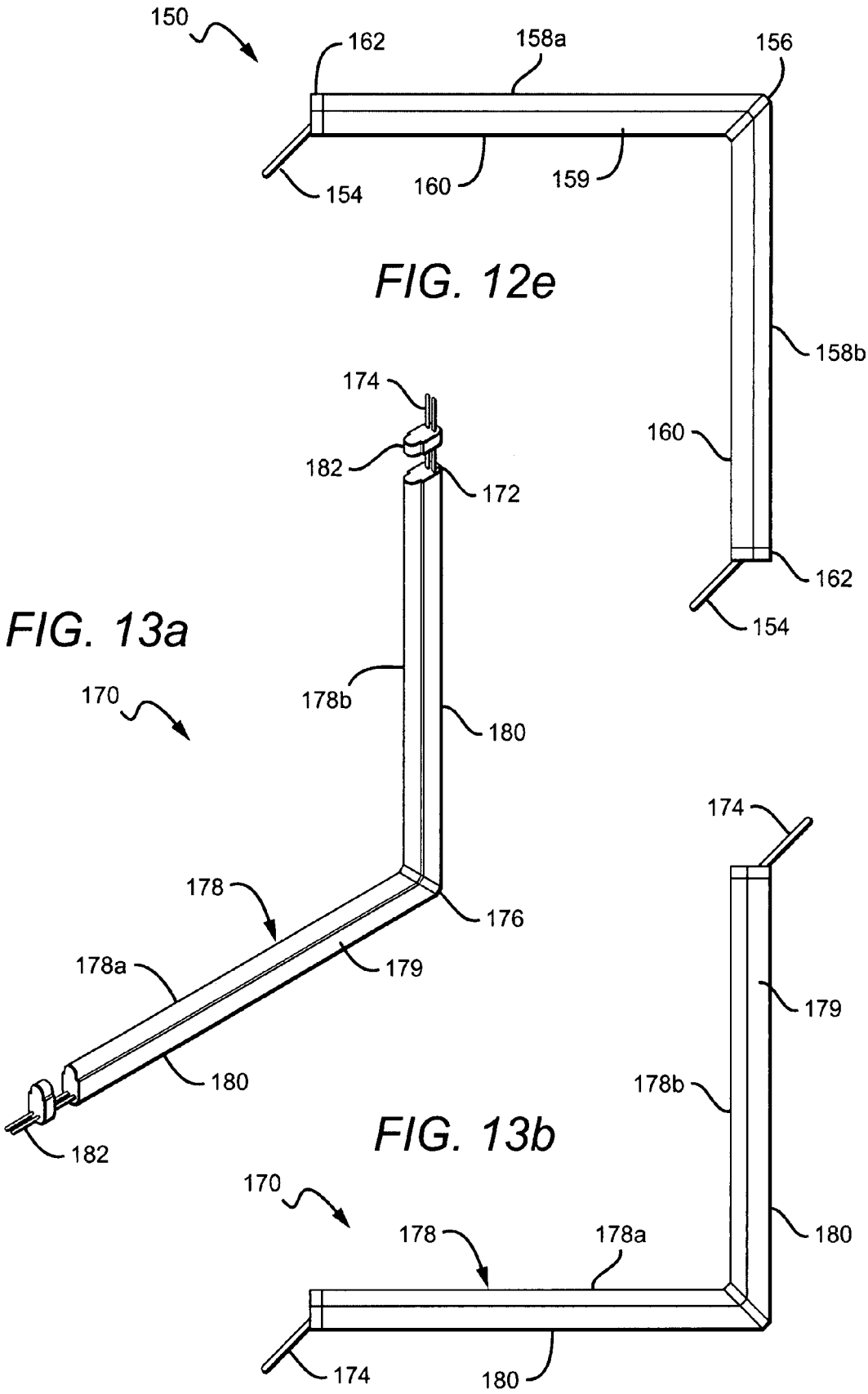
FIG. 12*e* is a plan view of a outside angle perimeter light according to the present invention.
FIG. 13*a* is a perspective view of an inside angle perimeter light according to the present invention.
FIG. 13*b* is a plan view of the perimeter light in FIG. 13*a;*

FIGS. 13*a* and 13*b* show another embodiment of an angled perimeter light 170 according to the present invention, comprising a PCB 172, wire bus 174, center plug 176, tube 178 with a blocking element 179, and bumpers 182. It is fabricated in much the same way as perimeter light 150 described above, but the tube sections 178*a*, 178*b* are angle cut so that the light 170 can be mounted to an "inside corner". The mounting surface 180 is on the outside of the lights 90 degree angle. The light 170 can be mounted to an inside corner using one or more of the mounting bracket 100 and/or anchoring bracket 120 described above, and can be connected to other perimeter lights at the wire bus 174.

Figure 14A:
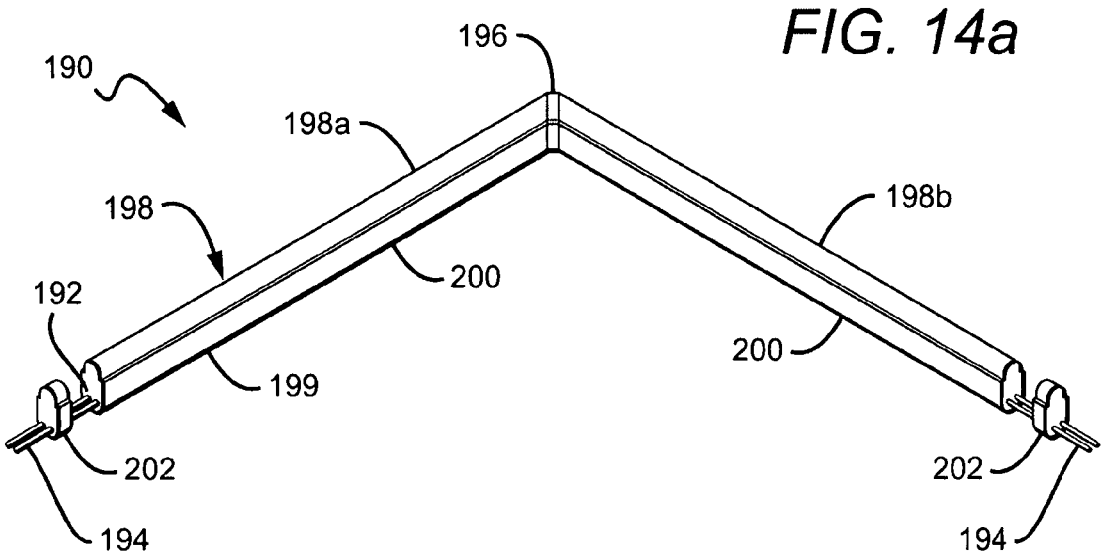
FIG. 14*a* is a perspective view of a flat or step angle perimeter light according to the present invention.
Figure 14B:
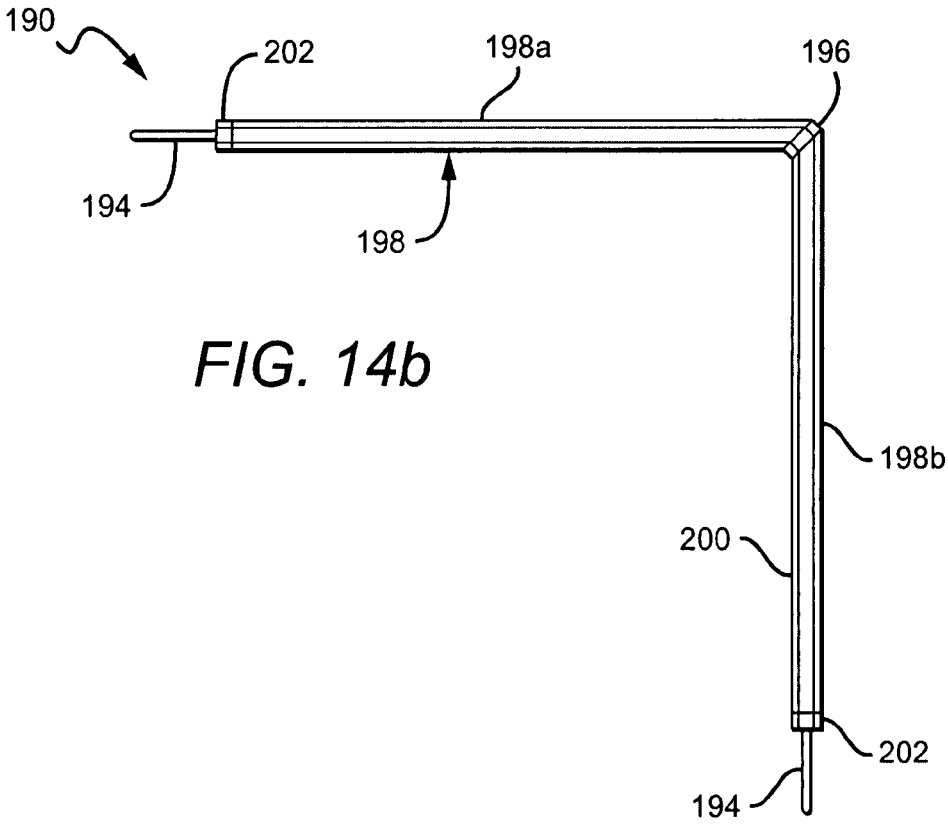
FIG. 14*b* is a plan view of the perimeter light in FIG. 14*a;*

FIGS. 14*a* and 14*b* show still another embodiment of an angled perimeter light 190 according to the present invention, comprising a PCB 192, wire bus 194, center plug 196, tube 198 with a blocking element 199, and bumpers 202. Light 190 is also fabricated in much the same way as perimeter light 150 described above, but the tube sections 198*a*, 198*b* are angle cut so that the light 190 has a "flat" or "step" 90 degree angle. The mounting surface 200 is not on the inside or outside of the angle, but is instead along one of the light's edges. The light 190 can be mounted to an inside corner using one or more of the mounting bracket 100 and/or anchoring bracket 120 described above and can be connected to other lights in a daisy-chain.

Figure 15:
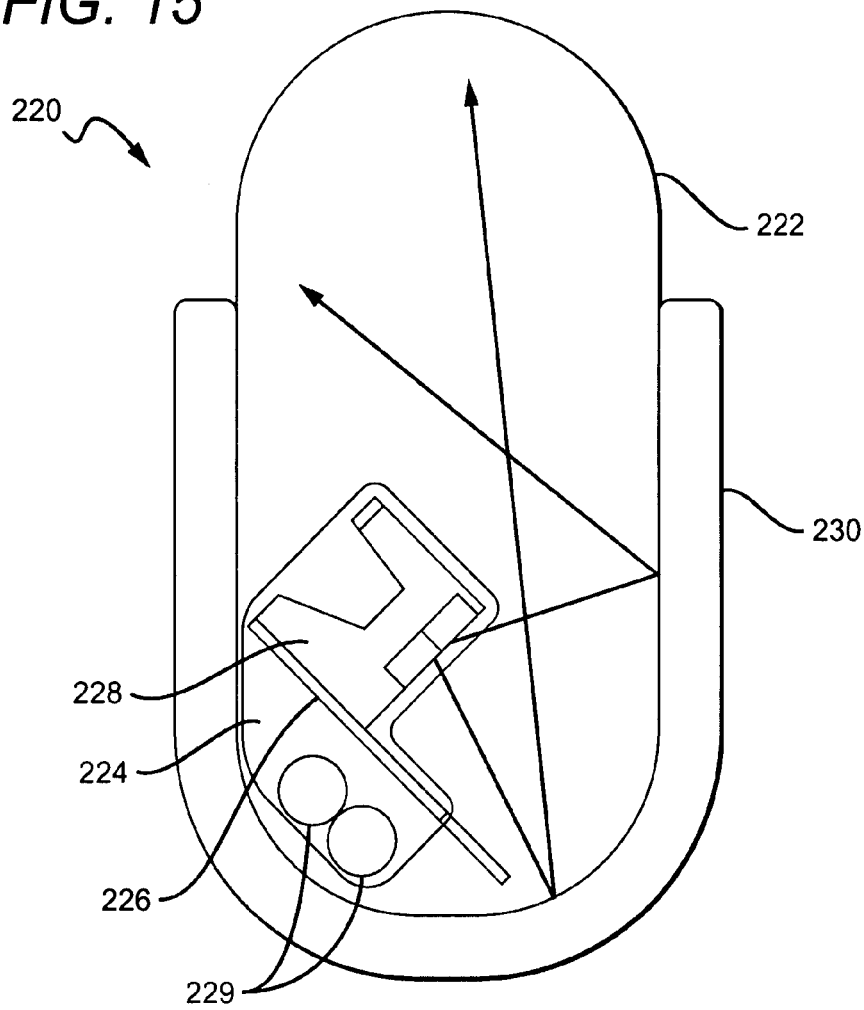
FIG. 15 is a sectional view of another embodiment of a perimeter light according to the present invention.

It is understood that the tube, lumen and light emitters according to the present invention can be arranged in many different ways and with different elements to disperse the light and provide the appearance of a continuous light source. FIG. 15 shows one alternative embodiment of a perimeter light 220 according to the present invention comprising a tube 222 that can be made of the same materials as the tube described above. Alternatively the tube can be made of a resilient material so that it is flexible and can be bent by hand to match structural features. The tube 222 includes a lumen or bore 224 housing a PCB 226 and LEDs 228 mounted to the PCB 226. A wire bus 229 is also arranged within the lumen 224, with the PCB electrically connected to the wire bus 229 so that the electrical signal on the wire bus 229 is transmitted to the LEDs 228 on the PCB 226.

The tube 222 is substantially solid except for the lumen 224. The PCB 226 is arranged at an angle with the LEDs 228 emitting light generally downward away from the top of the tube 222. The perimeter light 220 also has a blocking element 230 that is arranged similarly and made of the similar material as the blocking element 18 described above. The light from the LED 228 is generally directed down where it reflects off the blocking element 230 back towards the top (primary emitting) surface of the tube 222. These reflection characteristics allow for a longer light path from the LEDs 228 to the top of the tube 222. Through this longer path the light can be more completely dispersed by having a greater chance to interact with the dispersing material. The perimeter light 220 represents only one of the many alternative arrangements for the present invention. For example, another embodiment could have a vertical PCB the LEDs emitting light directly at the bottom surface of the tube.

Figure 16:
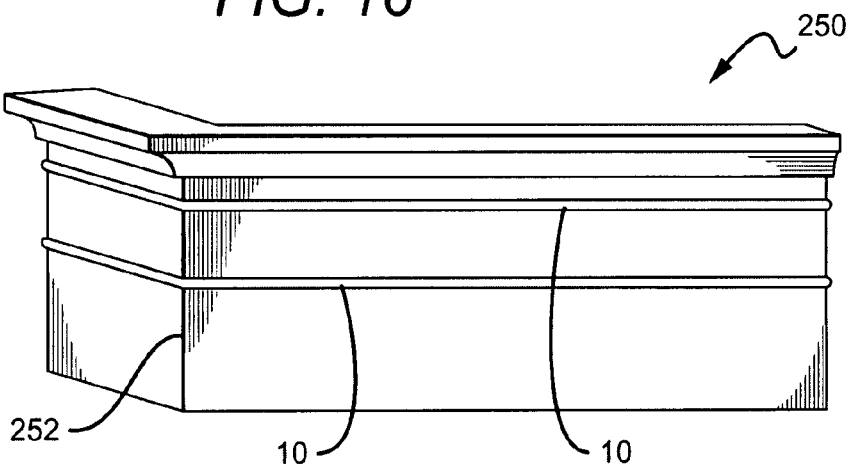
FIG. 16 is a perspective view of building's structural feature with one embodiment of the perimeter lighting according to the present invention.

FIG. 16 shows one embodiment of the perimeter lights 10 as they are mounted to a structural feature 250. Before mounting the lights, the mounting brackets and anchoring brackets, if desired should be affixed to the structural feature 250 at intervals along a line where the perimeter light is to be attached. The perimeter lights 10 can then be snapped into the mounting brackets and an adhesive can be included on the anchoring brackets as desired. The lights 10 can also be cut to meet the length of the structural feature 250 as described above. After cutting, one of the end bumpers (not shown) should be mounted to the open end of the tube to protect the LED array and to provide cushioning between adjacent lights. More than one light 10 can be daisy chained together to light a longer structural feature with the joint between the lights covered by a joint cover. The perimeter lights 10 can also be mounted around a 90-degree corner 252 of the structural feature 250, with the corner joint between the lights covered by joint cover. The covers give the appearance of a continuous perimeter light along the feature 160. In another embodiment a 90 degree section of perimeter lighting can be provided as shown in FIGS. 12*a* through 12*e*.

Although the present invention has been described in considerable detail with reference to certain preferred configurations thereof, other versions are possible. Therefore, the spirit and scope of the invention should not be limited to their preferred versions described above.

We claim:

1. An elongated perimeter light, comprising:

an array of light sources that are illuminated by electric power;

an elongated tube having a lumen extending along the entire length of said tube, said tube formed of transparent or translucent material and being substantially solid except for said lumen;

an elongated PCB, said PCB held in said lumen; and a blocking element covering a lower portion of said tube along its length, wherein said blocking element is distinct from said lumen, said PCB, and said tube and in contact with an external surface of said lower portion of said tube, partially covering said tube, said blocking element blocking light emission from said lower portion, wherein said array of light sources is arranged within said lumen and transmits light through said tube and from an upper surface of said tube, said tube dispersing the light from said array giving the appearance that said array of light sources is a continuous light source, and wherein said array of light sources is cuttable at intervals to shorten said array while allowing the remaining light sources in the resulting cut pieces to emit light, said tube and blocking element being cuttable to match the length of said array.

2. The perimeter light of claim 1, wherein said lumen is in the lower half of said tube.

3. The perimeter light of claim 1, wherein said lumen is in the lower third of said tube.

4. The perimeter light of claim 1, wherein said light sources are mounted to said PCB.

5. The perimeter light of claim 4, wherein said PCB is held in said lumen by the surfaces of said lumen bearing against said PCB.

6. The perimeter light of claim 5, wherein said PCB is longitudinally slideable within said lumen.

7. The perimeter light of claim 1, wherein said array of light sources comprises an array of light emitting diodes (LEDs).

8. The perimeter light of claim 7, wherein said array of LEDs is arranged as a plurality of parallel connected sub-arrays of LEDs, said electric power coupled across each of said plurality sub-arrays.

9. The perimeter light of claim 8, wherein said array of LEDs is cuttable between two of said plurality of parallel connected sub-arrays.

10. The perimeter light of claim 1, further comprising a bracket for mounting to a structure.

11. The perimeter light of claim 10, wherein said bracket comprises a clamp and a mount.

12. The perimeter light of claim 11, wherein said perimeter light is held in said clamp and said mount is mounted to said structure.

13. The perimeter light of claim 1, further comprising an anchoring bracket.

14. The perimeter light of claim 1, further comprising a dispersing material in said tube.

15. The perimeter light of claim 14, wherein said dispersing material comprises $TiO_2$.

16. The perimeter light of claim 14, wherein said dispersing material comprises an acrylic frost.

17. The perimeter light of claim 1, further comprising electrical conductors for connection to others of said perimeter lights to couple said perimeter lights in a daisy-chain.

18. The perimeter light of claim 1, further comprising bumpers at the end of said tube, said bumpers providing a watertight seal over said lumen.

19. The perimeter light of claim 18, wherein said bumpers comprise a resilient material to compensate for expansion and contraction of said light, blocking element, and array of light sources.

20. The perimeter light of claim 1, wherein said elongated tube has first and second sections arranged at an angle to one another.

21. The perimeter light of claim 20, further comprising a resilient center plug between said first and second sections.

22. The perimeter light of claim 20, wherein at least one end of each of said first and second sections is angle cut.

23. A system for lighting structural features, comprising: a plurality of elongated perimeter lights, each of which comprises: an array of semiconductor light emitters that are illuminated by electric power; an elongated tube having a lumen extending along the entire length of said tube, said tube formed of transparent or translucent material and being substantially solid except for said lumen; an elongated PCB, said PCB held in said lumen; and a blocking element covering a lower portion of said tube along its length, wherein said blocking element is distinct from said lumen and said PCB and distinct from and blocking light emission from a portion of said tube, said blocking element in contact with an external surface of said portion of said tube, partially covering said tube, wherein said tube, said blocking element, and said array of light emitters are cuttable at intervals to shorten said perimeter light, wherein said plurality of perimeter lights is electrically coupled in a daisy-chain with the electrical power at each of said plurality of perimeter lights transmitted to the successive of said plurality of perimeter lights; and a mechanism for mounting said plurality of perimeter lights to a structure.

24. The system of claim 23, wherein said light emitters on each of the remaining cut sections of said perimeter lights are capable of being illuminated by electrical power.

25. The system of claim 23, wherein said lumen is in the lower half of said tube.

26. The system of claim 23, wherein said light emitters are mounted to said PCB.

27. The system of claim 26, wherein each said PCB is held in its said lumen by the surfaces of said lumen bearing against said PCB.

28. The system of claim 27, wherein each said PCB is longitudinally slideable within its respective said lumen.

29. The system of claim 23, wherein said array of light emitters comprises an array of light emitting diodes (LEDs).

30. The system of claim 23, wherein said array of light emitters is arranged as a plurality of parallel connected sub-arrays of emitters, said electric power coupled across each of said plurality sub-arrays.

31. The system of claim 23, wherein said array of emitters is cuttable between two of said plurality of parallel connected sub-arrays.

32. The system of claim 23, wherein said mechanism for mounting comprises a mounting bracket.

33. The system of claim 23, further comprising an anchoring bracket.

34. The system of claim 23, wherein each said tube disperses the light from its respective said light emitters giving the appearance that said array of light emitters is a continuous light source.

35. The system of claim 34, wherein each said tube comprises a dispersing material.

36. The system of claim 23, further comprising electrical conductors for connection between said perimeter lights in said daisy-chain.

37. The system of claim 23, further comprising bumpers at the end of said tube, said bumpers providing a watertight seal over said lumen.

38. The system of claim 37, wherein said bumpers comprise a resilient material and provide a compression zone between adjacent ones of said perimeter lights.

39. The system of claim 23, wherein one of said plurality of elongated perimeter lights comprises an elongated tube having first and second sections arranged at an angle to one another for lighting an angled structural feature.

40. The system of claim 39, further comprising a resilient center plug between said first and second sections.

41. The system of claim 40, wherein said center plug is compressible to compensate for expansion and contraction of said sections during thermal cycles.

42. The system of claim 40, wherein said center plug provides a flexible interface between said first and second sections to permit mounting of said light to structural features within a range of angles.

43. The system of claim 39, wherein at least one end of each of said first and second sections is angle cut.

44. The system of claim 39, wherein said first and second sections are angled to illuminate one of the angled structural features comprising inside, outside, and flat angles.

* * * * *